US008364068B2

(12) United States Patent
Ichikawa et al.

(10) Patent No.: US 8,364,068 B2
(45) Date of Patent: Jan. 29, 2013

(54) FIXING DEVICE AND IMAGE FORMING APPARATUS

(75) Inventors: Junichi Ichikawa, Ebina (JP); Junpei Amano, Ebina (JP); Aya Kakishima, Ebina (JP); Masaya Nakatsuhara, Ebina (JP); Sho Watanabe, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/715,833

(22) Filed: Mar. 2, 2010

(65) Prior Publication Data

US 2011/0064492 A1 Mar. 17, 2011

(30) Foreign Application Priority Data

Sep. 17, 2009 (JP) ..... 2009-215191

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 2006/0083567 | A1 | 4/2006 | Ito et al. | |
| 2009/0116885 | A1 | 5/2009 | Ando | |
| 2012/0201579 | A1 * | 8/2012 | Kunii et al. | 399/328 |

FOREIGN PATENT DOCUMENTS

| | | | |
|---|---|---|---|
| EP | 1617302 | A2 | 1/2006 |
| EP | 1925989 | A2 | 5/2008 |
| JP | 2002-296937 | A | 10/2002 |
| JP | 2007-108405 | A | 4/2007 |

OTHER PUBLICATIONS

Extended European Search Report in corresponding European Patent Application No. 10156196.7-1240/2325703.

* cited by examiner

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

A fixing device includes: a belt member provided to be circularly movable; a first fixing member disposed inside the belt member; a second fixing member that is disposed to be in press contact with the first fixing member across the belt member, and forms a press contact portion between the belt member and the second fixing member; a pressing member that presses the belt member against the second fixing member, the pressing member having a pressing surface that presses an inner peripheral surface of the belt member on a downstream side of the press contact portion in a moving direction of the belt member; and a suppressing unit that suppresses looseness in a portion of the belt member in the width direction thereof, the portion being located on the downstream side of the press contact portion and an upstream side of the pressing surface in the moving direction of the belt member.

15 Claims, 10 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2009-215191 filed Sep. 17, 2009.

BACKGROUND

1. Technical Field

The present invention relates to a fixing device and an image forming apparatus.

2. Related Art

Many types of fixing devices for fixing an unfixed toner image formed on a recording medium have been known.

SUMMARY

According to an aspect of the present invention, there is provided a fixing device including: a belt member provided to be circularly movable; a first fixing member disposed inside the belt member; a second fixing member that is disposed to be in press contact with the first fixing member across the belt member, and forms a press contact portion between the belt member and the second fixing member; a pressing member that presses the belt member against the second fixing member, the pressing member having a pressing surface that presses an inner peripheral surface of the belt member on a downstream side of the press contact portion in a moving direction of the belt member; and a suppressing unit that suppresses looseness in a portion of the belt member in a width direction thereof, the portion being located on the downstream side of the press contact portion and an upstream side of the pressing surface in the moving direction of the belt member.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, the first exemplary embodiment of the present invention will be described in detail with reference to the attached drawings.

Figure 1:
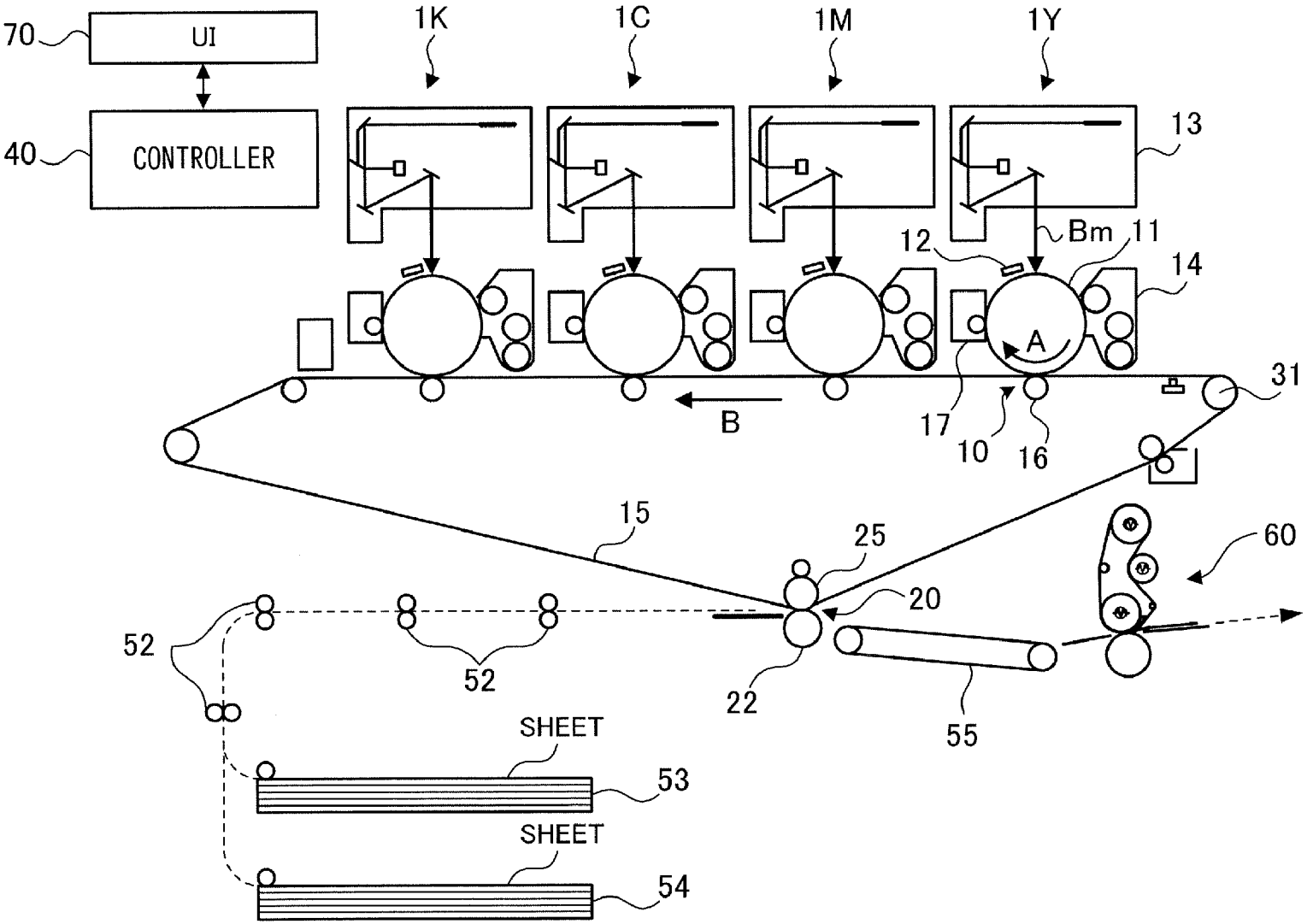
FIG. 1 is a schematic block diagram showing an image forming apparatus to which a first exemplary embodiment is applied.

FIG. 1 is a schematic block diagram showing an image forming apparatus to which the first exemplary embodiment is applied. The image forming apparatus shown in FIG. 1 is an image forming apparatus of an intermediate transfer system generally called a tandem type. In this image forming apparatus, plural image forming units 1Y, 1M, 1C and 1K are provided and each unit forms a toner image of a corresponding color component by an electrophotographic system. A primary transfer part 10 is also provided to sequentially transfer (primarily transfer) the toner images of the respective color components formed by the image forming units 1Y, 1M, 1C and 1K to an intermediate transfer belt 15.

The image forming apparatus further has a secondary transfer part 20 that collectively transfers (secondarily transfers) the superimposed toner images transferred to the intermediate transfer belt 15 to a sheet, which is an example of a recording medium. A fixing device 60 for fixing the secondarily-transferred toner images to the sheet is also provided. Still further, there are provided a controller 40 for controlling operation of each device (each part) and a user interface (UI) 70 composed of a display panel and the like to receive information from a user and to display information to a user. Here, the image forming units 1Y, 1M, 1C and 1K, the intermediate transfer belt 15, the secondary transfer part 20 and the like may be integrally captured as an image forming unit that forms an image on a sheet.

In this exemplary embodiment, the following electrophotographic devices are disposed in each of the image forming units 1Y, 1M, 1C and 1K. A charging device 12 that charges a photoconductive drum 11 is mounted on the periphery of the photoconductive drum 11 that rotates in the direction of arrow A. A laser exposure device 13 is also provided, above the photoconductive drum 11, to form an electrostatic latent image (an exposure beam is shown by a reference Bm in the figure). Further, a developing device 14 that accommodates toner of each color component and visualizes the electrostatic latent image with the toner is also disposed. Still further a primary transfer roll 16 is provided to transfer the toner images of the respective color components formed on the photoconductive drum 11 to the intermediate transfer belt 15 in the primary transfer part 10. A drum cleaner 17 that removes residual toner on the photoconductive drum 11 is further provided.

The intermediate transfer belt 15 is circularly moved at a predetermined speed in a direction of arrow B shown in FIG. 1 by a drive roll 31 which is driven by a motor (not shown) having an excellent constant speed control property. The primary transfer part 10 includes the primary transfer roll 16 disposed to face the photoconductive drum 11 across the intermediate transfer belt 15. The toner images on the respective photoconductive drums 11 are electrostatically attracted to the intermediate transfer belt in sequence, thereby forming the superimposed toner images on the intermediate transfer belt 15. The secondary transfer part 20 includes a secondary transfer roll 22 disposed at a side of a toner image carrying surface of the intermediate transfer belt 15 and a backup roll 25. The secondary transfer roll 22 is disposed in press contact with the backup roll 25 across the intermediate transfer belt 15. Further, the secondary transfer roll 22 is grounded, and a secondary transfer bias is generated between the secondary transfer roll 22 and the backup roll 25 to secondarily transfer the toner images to a sheet transported to the secondary transfer part 20.

Next, a basic image forming process of the image forming apparatus to which this exemplary embodiment is applied will be described. In the image forming apparatus shown in FIG. 1, image data is outputted from an image reading device and the like, which is not shown. The image data is subjected to image processing by an image processing device, which is not shown, to be converted into grey level data of coloring materials of four colors, Y, M, C and K, and then outputted to the laser exposure device 13.

The laser exposure device 13 irradiates the photoconductive drum 11 of each of the image forming units 1Y, 1M, 1C and 1K with an exposure beam Bm emitted by, for example, a semiconductor laser in response to the inputted grey level data of coloring materials. In each photoconductive drum 11, the surface is charged by the charging device 12, and then exposed by the laser exposure device 13 to form the electrostatic latent image. The developing device 14 forms the toner image on the photoconductive drum 11, and the toner image is transferred to the intermediate transfer belt 15 at the primary transfer part 10 where each photoconductive drum 11 contacts the intermediate transfer belt 15.

After the toner images are primarily transferred to the surface of the intermediate transfer belt 15 in sequence, the toner images are transported to the secondary transfer part 20 by movement of the intermediate transfer belt 15. In the secondary transfer part 20, the secondary transfer roll 22 is pressed against the backup roll 25 across the intermediate transfer belt 15. Then a sheet transported by transporting rolls 52 and the like from a first sheet storage part 53 or a second sheet storage part 54 is inserted between the intermediate transfer belt 15 and the secondary transfer roll 22. The unfixed toner images carried on the intermediate transfer belt 15 are electrostatically transferred to the sheet collectively at the second transfer part 20. The sheet on which the toner images have been electrostatically transferred is stripped from the intermediate transfer belt 15, and fed to a transporting belt 55 provided downstream of the secondary transfer roll 22 in the sheet transporting direction. The transporting belt 55 transports the sheet to the fixing device 60.

The fixing device 60 will be described next.

Figure 2B:
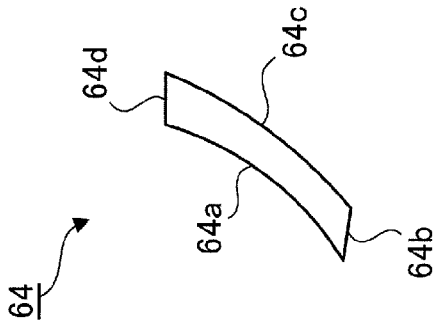
FIGS. 2A and 2B are side cross-sectional views showing a schematic configuration of a fixing device.
Figure 2A:
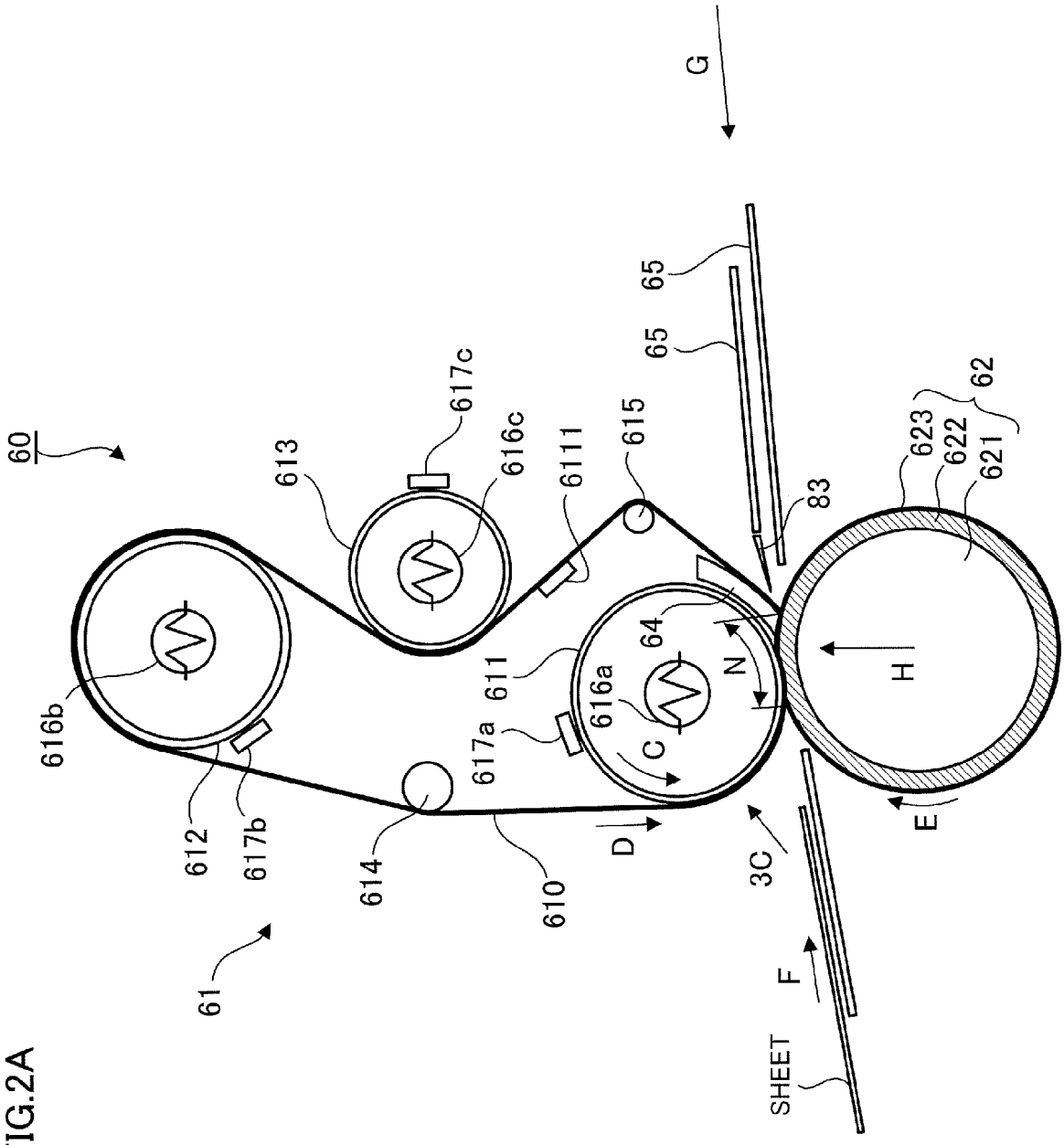
Figure 3A:
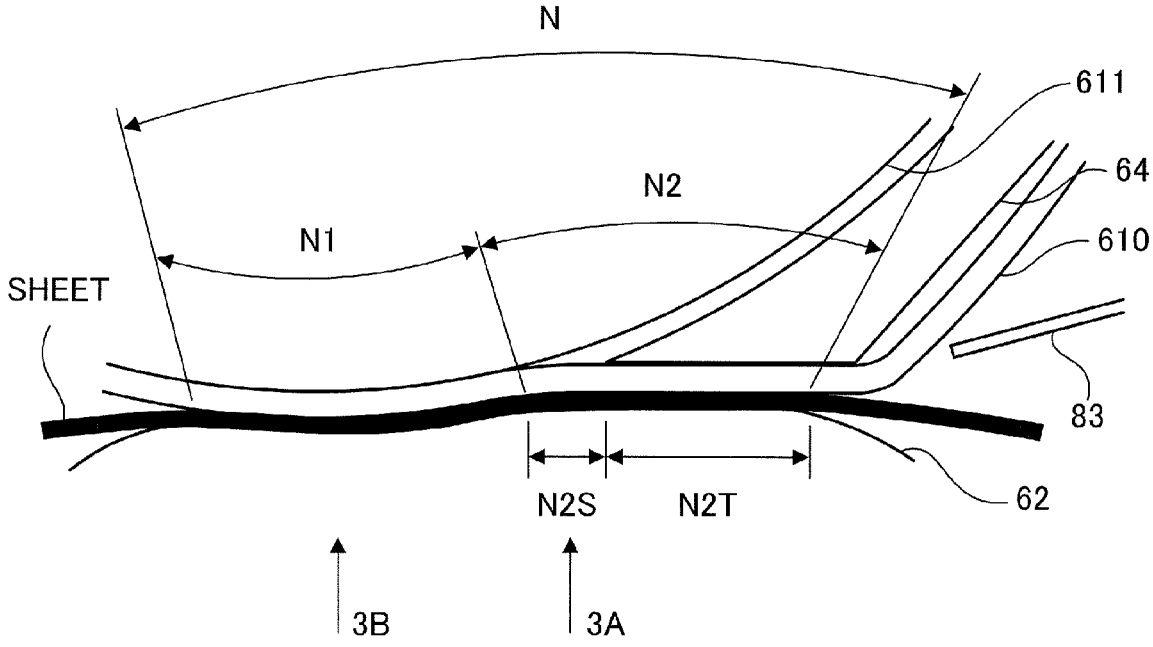
FIGS. 3A and 3B illustrate a nip portion.
Figure 3B:
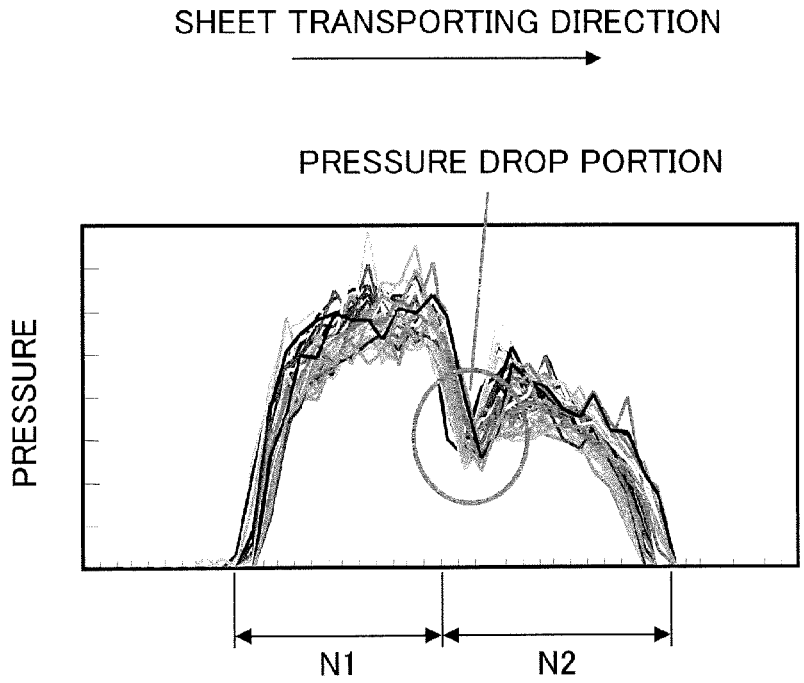

FIGS. 2A and 2B are side cross-sectional views showing a schematic configuration of the fixing device 60. FIGS. 3A and 3B illustrate a nip portion N.

As shown in FIG. 2A, the main part of the fixing device 60 is composed of a fixing belt module 61 with a fixing belt 610 and a pressure roll 62 provided in contact with the fixing belt module 61 and pressing the fixing belt 610 in a direction toward the inside of the fixing belt module 61 (a direction of arrow H in the figure). The fixing device 60 also has a nip portion N between the fixing belt module 61 and the pressure roll 62, where toner images are fixed to a sheet by heat and pressure.

The fixing belt module 61 has a fixing belt 610 (an example of a belt member) which is formed in an endless shape and configured to be circularly movable, a fixing roll 611 (an example of a first fixing member) which is provided inside of the fixing belt 610 and circularly drives the fixing belt 610 while providing tension to the fixing belt 610 and a first tension roll 612 which provides tension to the fixing belt 610 from the inside thereof. The fixing roll 611 is disposed in parallel in a longitudinal direction thereof to a width direction of the fixing belt 610. The fixing belt module 61 also has a second tension roll 613 which is disposed outside of the fixing belt 610 to define a circular route of the fixing belt 610 and an attitude correction roll 614 that corrects the attitude of the fixing belt 610 at a position between the fixing roll 611 and the first tension roll 612. The fixing belt module 61 further includes a stripping pad 64 disposed in an area in the downstream side within a nip portion N where the fixing belt module 61 and the pressure roll 62 are in press contact, and a third tension roll 615 that provides tension to the fixing belt 610 at a downstream side of the nip portion N. Still further, a drive motor (not shown) is provided to circularly drive the fixing roll 611 in a direction of arrow C in the figure. The fixing belt module 61 is provided with a lubricant supply member 6111 disposed in contact with an inner peripheral surface of the fixing belt 610 to supply lubricant to the inner peripheral surface.

The fixing belt 610 is a flexible endless belt having a peripheral length of about 314 mm. The fixing belt 610 is composed of a base layer formed of polyimide resin of about 80 μm thickness, an elastic layer laminated on the surface side (outer peripheral surface side) of the base layer formed of silicone rubber with the thickness of about 450 μm, and further a release layer formed of a PFA (tetrafluoroethylene/perfluoroalkyl vinyl ether copolymer resin) tube with a thickness of about 35 μm coated on the elastic layer. The elastic layer is provided to improve image quality, especially, of a color image. As for the configuration of the fixing belt 610, materials, thicknesses or hardness may be selected depending on machine design conditions such as an intended purpose and conditions of use. The fixing belt 610 rotates at a predetermined speed in the direction of arrow D in FIG. 2A by the rotation of the fixing roll 611.

The fixing roll 611 is formed to have a hollow body. Specifically, the fixing roll 611 is a hard roll in which a coating of fluorine resin with a thickness of about 200 μm is formed on a cylindrical core roll as a protective layer for preventing wearing in a surface of the cylindrical core roll made of aluminum with an outer diameter of about 65 mm and thickness of about 10 mm. However, the configuration of the fixing roll 611 is not limited thereto; the fixing roll 11 may have any configuration that functions as a roll having sufficient hardness to the degree that deformation is rarely observed in the fixing roll 611 though a pressing force is exerted by the pressure roll 62 when the nip portion N is formed between the fixing roll 611 and the pressure roll 62. The fixing roll 611 rotates at a surface speed of, for example, about 440 mm/s in the direction of arrow C due to a driving force from a drive motor (not shown).

Inside the fixing roll 611, a first halogen heater 616*a* (a heat source) rated at 900 W is provided. The fixing roll 611 is controlled to have a surface temperature of about 150° C. based on a measurement value of a first temperature sensor 617*a* disposed to be in contact with the surface of the fixing roll 611.

The first tension roll 612 is substantially a cylindrical roll made of aluminum with an outer diameter of about 30 mm and a thickness of about 2 mm. Inside the first tension roll 612, a second halogen heater 616*b* rated at 1000 W is provided as a heat source. The first tension roll 612 is controlled to have a surface temperature of about 190° C. based on a measurement value of a second temperature sensor 617*b* disposed to be in contact with the surface of the first tension roll 612. Accordingly, the first tension roll 612 has a function to heat the fixing belt 610 from the inside, as well as to provide tension to the fixing belt 610.

The second tension roll 613 is substantially a cylindrical roll made of aluminum with an outer diameter of about 25 mm and a thickness of about 2 mm. On the surface of the second tension roll 613, a release layer made of fluorine resin with a thickness of about 20 μm is formed. The release layer is formed to prevent deposition of toner or paper debris, having been adhered to the peripheral surface of the fixing belt 610, on the second tension roll 613.

Inside the second tension roll 613, a third halogen heater 616*c* rated at 1000 W is provided. The second tension roll 613 is controlled to have a surface temperature of about 190° C.

based on a measurement value of a third temperature sensor 617*c* disposed to be in contact with the surface of the second tension roll 613. Accordingly, the second tension roll 613 has a function to heat the fixing belt 610 from the outer peripheral surface side, as well as to provide tension to the fixing belt 610. That is to say, this exemplary embodiment has a configuration in which the fixing belt 610 is heated by the fixing roll 611, the first tension roll 612 and the second tension roll 613.

The attitude correction roll 614 is substantially a cylindrical roll made of aluminum with an outer diameter of about 15 mm. In the fixing device 60, a belt edge position detection mechanism (not shown) for detecting a position of an edge of the fixing belt 610 is provided. The attitude correction roll 614 is provided with a shifting mechanism that shifts a position of the attitude correction roll 614 in contact with the fixing belt 610 in the axial direction thereof in response to the detection result of the belt edge position detection mechanism, thereby controlling walk of the fixing belt 610 in this exemplary embodiment.

The stripping pad 64, as an example of a pressing member, is substantially a block-like member formed of a rigid body such as resin or metal, for example SUS, with a length corresponding to that of the fixing roll 611 in the axial direction, and disposed in parallel in a longitudinal direction thereof to the width direction of the fixing belt 610. The stripping pad 64 has, as shown in FIG. 2B, an inside surface 64*a* that faces the fixing roll 611, a pressing surface 64*b* that contacts an inner peripheral surface of the fixing belt 610 and presses the fixing belt 610 against the pressure roll 62, an outside surface 64*c* that forms an angle with the pressing surface 64*b* to sharply turn a moving direction of the fixing belt 610 (bend the fixing belt 610) and an upper surface 64*d*, and the stripping pad 64 is substantially arc-shaped in cross section.

The stripping pad 64 is provided downstream of an area (roll nip portion N1, refer to FIG. 3A) in the moving direction of the fixing belt 610, where the pressure roll 62 presses in contact with the fixing roll 611 across the fixing belt 610, throughout the whole area in the axial direction of the fixing roll 611. The stripping pad 64 is supported at both ends thereof. Specifically, each end of the stripping pad 64 is supported by an arm (not shown) swingably mounted around a support shaft (not shown) of the fixing roll 611. Further, the stripping pad 64 is urged by an urging unit which is not shown, such as a spring, to press the fixing belt 610 against the pressure roll 62 with a predetermined load (for example, about 10 kgf). Accordingly, a stripping pad nip portion N2 (refer to FIG. 3A) having a width of, for example, about 5 mm is formed along the moving direction of the fixing belt 610.

The third tension roll 615 is substantially a cylindrical roll made of aluminum with an outer diameter of about 12 mm. The third tension roll 615 is disposed downstream of the stripping pad 64 in the moving direction of the fixing belt 610 so that the fixing belt 610 having passed the stripping pad 64 may smoothly move toward the second tension roll 613.

The pressure roll 62, as an example of a second fixing member, is disposed in parallel in an axial direction thereof to the axial direction of the fixing roll 611 and has a length in the axial direction is shorter than those in the axial direction of the fixing roll 611 and in the width direction of the stripping pad 64. The pressure roll 62 is a soft roll composed of a cylindrical roll 621 made of aluminum with a diameter of about 45 mm as a base, and an elastic layer 622 formed of silicone rubber having a JIS (Japanese Industrial Standard)—A hardness of 30° with a thickness of about 10 mm and a release layer 623 formed by PFA tube with a thickness of abut 100 μm laminated on the base in this order.

The pressure roll 62 is urged in the direction of arrow H by an urging unit such as a spring, which is not shown, as well as rotatably supported. The pressure roll 62 is provided in press contact with a portion of the fixing belt 610, which is winding around the fixing roll 611. Accordingly, a roll nip portion N1 (refer to FIG. 3A) is formed at the portion where the pressure roll 62 is pressed against the fixing roll 611 (fixing belt 610). The pressure roll 62 rotates in the direction of arrow E following the rotation of the fixing roll 611 of the fixing belt module 61 in the direction of arrow C. The pressure roll 62 is not provided with any heat source, such as a halogen heater, inside thereof.

The fixing device 60 guides the sheet transported in the direction of arrow F shown in FIG. 2A to the nip portion N, and fixes the toner image formed on the sheet to the sheet by heat and pressure applied mainly at the roll nip portion N1 (refer to FIG. 3A). The heat applied in the nip portion N is supplied mainly by the fixing belt 610. The fixing belt 610 is subjected to heat supplied from the first halogen heater 616*a* disposed inside the fixing roll 611 via the fixing roll 611, heat supplied from the second halogen heater 616*b* disposed inside the first tension roll 612 via the first tension roll 612, and heat supplied from the third halogen heater 616*c* disposed inside the second tension roll 613 via the second tension roll 613. In this exemplary embodiment, heat energy is supplied from the first tension roll 612 and the second tension roll 613, in addition to the fixing roll 611, not to cause a decrease in temperature even at a process speed of about 440 mm/s.

As described above, the fixing roll, which is one of the members for forming the roll nip portion N1, is a hard roll made of aluminum, and the other member, namely, the pressure roll 62 is a soft roll coated with the elastic layer 622. Accordingly, the roll nip portion N1 in this exemplary embodiment is formed by deformation of the elastic layer 622 of the pressure roll 62. In the roll nip portion N1, the fixing roll 611 around which the fixing belt 610 is wound hardly deforms; and therefore, the rotating radius of the fixing belt 610 which moves along the surface of the fixing roll 611 does not substantially vary. Thereby the fixing belt 610 passes through the roll nip portion N1 while maintaining the moving speed substantially constant.

After passing through the roll nip portion N1, the sheet moves to the stripping pad nip portion N2. At an outlet of the stripping pad nip portion N2, the fixing belt 610 moves from the pressing surface 64*b* (refer to FIG. 2B) to the outside surface 64*c* of the stripping pad 64 such that the fixing belt 610 wraps around the stripping pad 64, and the fixing belt 610 sharply turns in the moving direction thereof to be directed toward the third tension roll 615. Therefore, the sheet having passed the stripping pad nip portion N2 is unable to follow the turning of the fixing belt 610 in the moving direction thereof at the time of exit from the stripping pad nip portion N2. Then the sheet is spontaneously stripped from the fixing belt 610 due to its stiffness. In short, the sheet is reliably separated from the fixing belt 610 at the time that the sheet exits from the stripping pad nip portion N2. The sheet separated from the fixing belt 610 is guided to a moving direction thereof by a stripping guide plate 83 disposed downstream of the stripping pad nip portion N2. Then the sheet guided by the stripping guide plate 83 is outputted to the outside of the device by an exit guide 65 and exit rolls (not shown), thereby finishing the fixing process.

In this exemplary embodiment, a pad mounted area N2T (refer to FIG. 3A) is set within the stripping pad nip portion N2, where the stripping pad 64 is mounted (a portion in which the stripping pad 64 and the pressure roll are in press contact). Between the pad mounted area N2T and the roll nip portion N1, a boundary area N2S (also refer to FIG. 3A) is formed. In the boundary area N2S, there is no member that presses the fixing belt 610; and therefore the fixing belt 610 is pressed in contact with the pressure roll 62 only by the tension. Accordingly, a nip pressure in the boundary area N2S is relatively lower than those in the roll nip portion N1 and the pad mounted area N2T. As a result, as shown in FIG. 3B, a pressure drop portion where the nip pressure is lower is formed at the upstream side (boundary area N2S) in the sheet transporting direction within the stripping pad nip portion N2.

Figure 4:
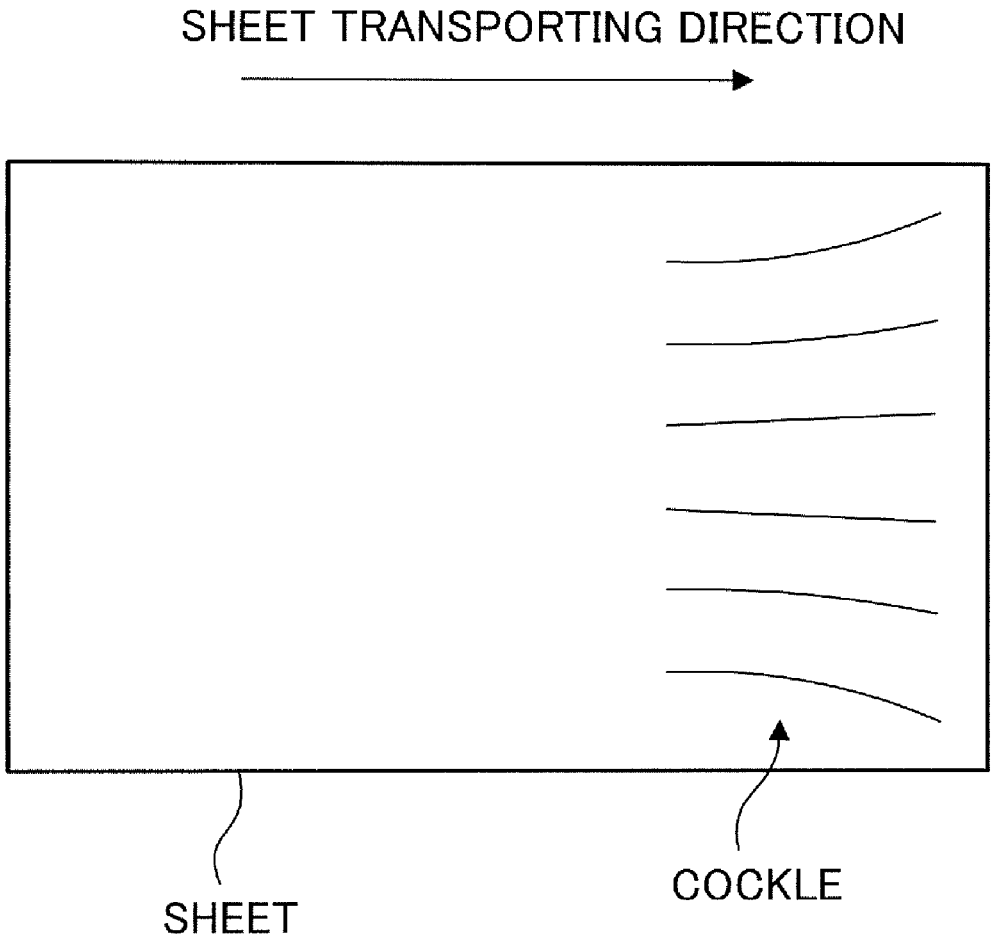
FIG. 4 illustrates a sheet after passing through the fixing device.

In the fixing process by the fixing device 60 of this exemplary embodiment, a sheet on which a toner image is formed is heated. In some cases, when the heat is applied, water content in the heated sheet is vaporized, thereby forming water vapor. Since high nip pressure is applied, the water vapor hardly occurs in the roll nip portion N1. However, in the case where the boundary area N2S (pressure drop portion) is formed as described above, the water vapor tends to be formed in the boundary area N2S. When the water vapor is formed and the water content in the sheet is reduced, sheet shrinkage occurs, and as shown in FIG. 4 (a view showing a sheet after passing through the fixing device 60), there are some cases where cockle occurs in the lead edge side of the sheet.

In this exemplary embodiment, further, a part of the fixing belt 610 positioned upstream of the fixing roll 611 is pulled by the fixing roll 611 which is rotatively driven. The fixing roll 611 rotatively driven also brings the fixing belt 610 out of the roll nip portion N1. In this exemplary embodiment, the stripping pad 64 is provided downstream of the roll nip portion N1, thereby a drag is imparted to the fixing belt 610 brought out of the roll nip portion N1. As a result, in the downstream side of the fixing roll 611 and in the upstream side of the stripping pad 64, that is, in the pressure drop portion, looseness tends to occur in the fixing belt 611. Specifically, in the fixing belt 610, the looseness readily occurs in a portion located downstream of the roll nip portion N1 and upstream of the pressing surface 64*b* of the stripping pad 64. In such a case, cockle more tends to occur in the sheet.

As described as follows, in the fixing device 60 of this exemplary embodiment, a mechanism for suppressing the looseness in the fixing belt 610 is provided. More specifically, a mechanism for providing tension to the fixing belt 610 in the width direction thereof is mounted.

Figure 5A:
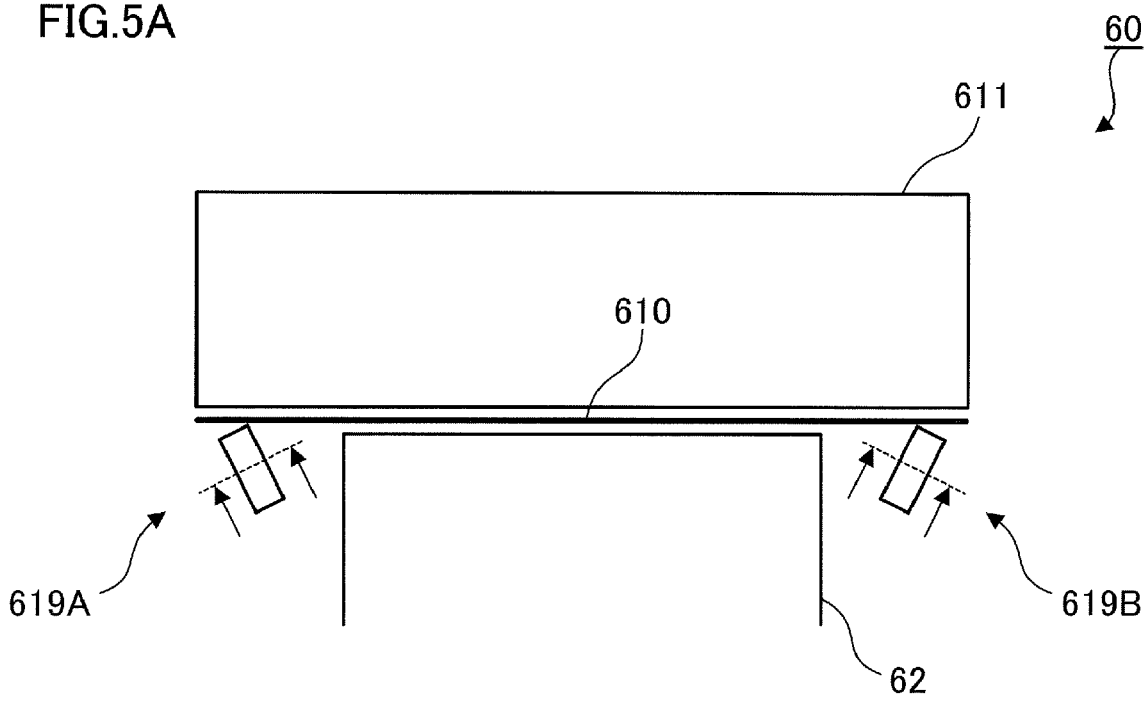
FIGS. 5A and 5B illustrate the fixing device as viewed from a direction of arrow G in FIG. 2A.
Figure 5B:
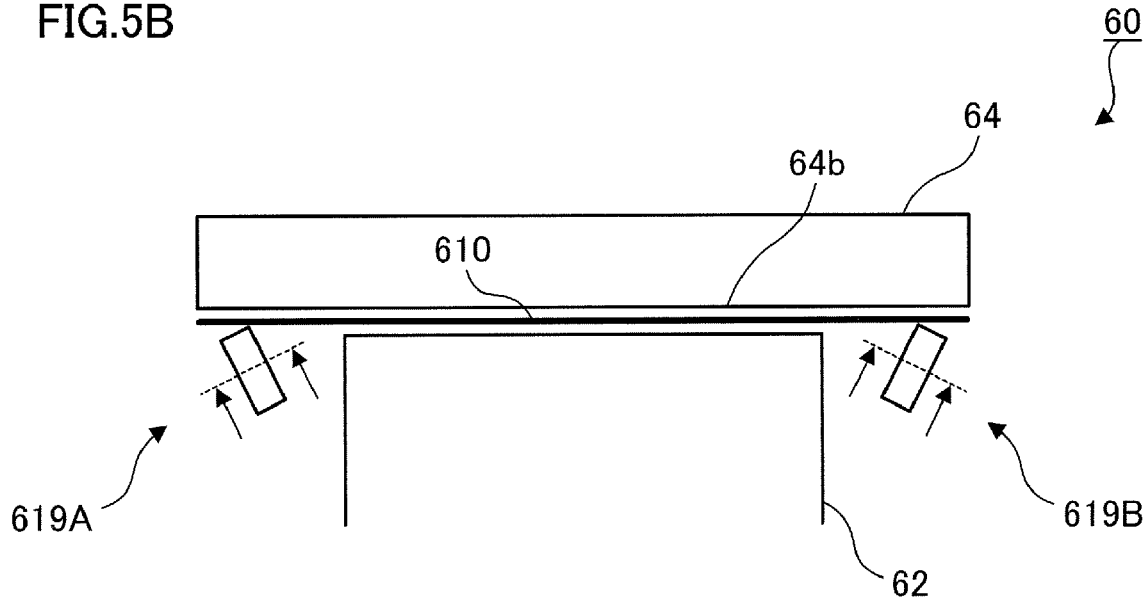

FIGS. 5A and 5B illustrate the fixing device 60 as viewed from the direction of arrow G in FIG. 2A. In the figure, the exit guide 65 and the second tension roll 613 are omitted.

Though not described so far, as shown in FIG. 5A, a first pressing member 619A and a second pressing member 619B for pressing the fixing belt 610 against the fixing roll 611 are provided. The first pressing member 619A and the second pressing member 619B may be captured as an example of a suppressing unit that suppresses the looseness in the fixing belt 610.

The first pressing member 619A is disposed to face one end portion of the fixing belt 610 in the width direction thereof and presses the one end portion against the fixing roll 611. The first pressing member 619A also presses the one end portion in a direction away from the other end portion of the fixing belt 610. Specifically, the first pressing member 619A does not press the fixing belt 610 in a direction orthogonal to the inner peripheral surface of the fixing belt 610, but presses the fixing belt 610 in a direction intersecting the direction orthogonal to the inner peripheral surface of the fixing belt 610. The second pressing member 619B is disposed to face the other end portion of the fixing belt 610 in the width direction thereof and presses the other end portion against the fixing roll 611. The second pressing member 619B also presses the other end portion in a direction away from the one end portion of the fixing belt 610. Specifically, the second pressing member 619B does not press the fixing belt 610 in a direction orthogonal to the inner peripheral surface of the fixing belt 610, but presses the fixing belt 610 in a direction intersecting the direction orthogonal to the inner peripheral surface of the fixing belt 610.

In the case where the first pressing member 619A and the second pressing member 619B are disposed as such, tension in the width direction of the fixing belt 610 is applied. As a result, the looseness in the fixing belt 610 at the pressure drop portion hardly occurs, thereby suppressing the cockle in a sheet. When the tension is applied to the fixing belt 610 in the width direction thereof, the tension is also applied to a sheet; accordingly, shrinkage of the sheet is suppressed. As a result, the cockle in the sheet is suppressed more effectively.

The first pressing member 619A and the second pressing member 619B are composed of rotatable roll-like members not to impair the movement of the fixing belt 610. Pressing by the first pressing member 619A and the second pressing member 619B may be performed at the pressure drop portion (the boundary area N2S, a portion shown by arrow 3A in FIG. 3A). More specifically, a load may be directly applied to a portion of the fixing belt 610 which is located at the pressure drop portion to directly press the portion of the fixing belt 610.

However, not limited to direct pressing of the fixing belt 610 at the pressure drop portion, but the pressing may also be performed, for example, at the roll nip portion N1 (a portion shown by arrow 3B in FIG. 3A). Further, the pressing may be performed at the upstream side of the roll nip portion N1 in the moving direction of the fixing belt 610 (for example, a portion shown by arrow 3C in FIG. 2A).

The pressing of the fixing belt 610 by the first pressing member 619A and the second pressing member 619B may be performed, as shown in FIG. 5B, at portions facing the pressing surface 64*b* of the stripping pad 64. In other words, the fixing belt 610 may be pressed against the stripping pad 64. The fixing belt 610 may be pressed against, not only the pressing surface 64*b*, but also the outside surface 64*c* (refer to FIG. 2B). Two pairs of the first pressing member 619A and the second pressing member 619B may be provided to press the fixing belt 610 against both fixing roll 611 and stripping pad 64.

Second Exemplary Embodiment

Next, the second exemplary embodiment of the present invention will be described.

Figure 6A:
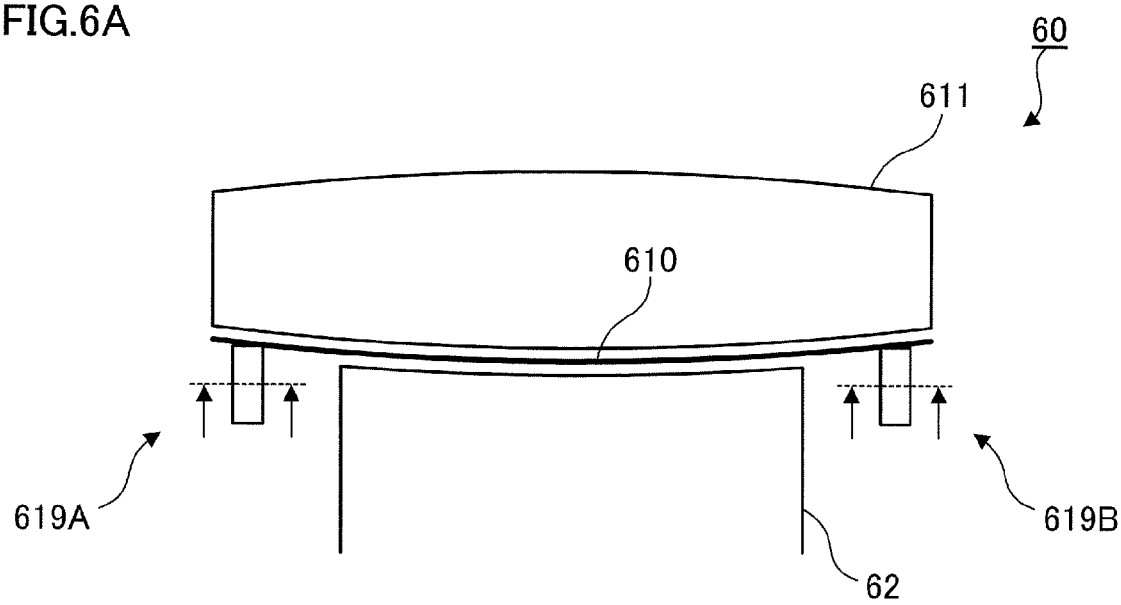
FIGS. 6A and 6B illustrate a fixing roll and fixing belt in a second exemplary embodiment.
Figure 6B:
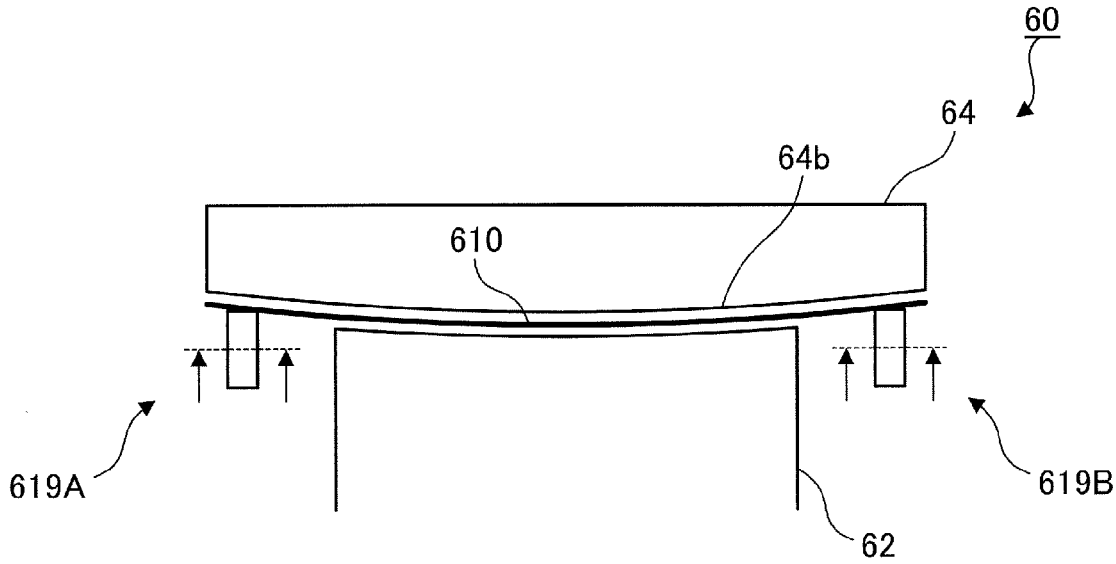

FIGS. 6A and 6B illustrate the fixing roll 611 and the fixing belt 610 in the second exemplary embodiment. In the fixing device 60 in this exemplary embodiment, as shown in FIG. 6A, the fixing roll 611 is formed to have a crown portion. That is, the fixing roll 611 is formed so that an outer diameter thereof is reduced along with a move toward both end portions. In other words, the fixing roll 611 is formed with a curvature so that a surface facing the fixing belt 610 is bent inward along with a move from a center portion to both end portions in the longitudinal direction of the fixing roll 611. In this exemplary embodiment, the first pressing member 619A and the second pressing member 619B are provided.

Here, the fixing roll 611 in this exemplary embodiment is formed to have a crown portion as described above; and therefore, when one end portion of the fixing belt 610 is pressed against one end portion of the fixing roll 611 by use of the first pressing member 619A and the other end portion of the fixing belt 610 is pressed against the other end portion of the fixing roll 611 by use of the second pressing member 619B, tension is applied to the fixing belt 610 in the width direction thereof. In this case, as in the first exemplary embodiment, the looseness in the fixing belt 610 at the pressure drop portion hardly occurs, thereby suppressing the cockle in a sheet. The tension is also applied to a sheet, and accordingly, the shrinkage of the sheet is suppressed. As a result, the cockle in the sheet is suppressed more effectively.

As in the first exemplary embodiment, the pressing of the fixing belt 610 by the first pressing member 619A and the second pressing member 619B may be performed at the pressure drop portion, but may alternatively be performed at the roll nip portion N1. Further, the pressing may be performed at the upstream side of the roll nip portion N1 in the moving direction of the fixing belt 610. The pressing of the fixing belt 610 by the first pressing member 619A and the second pressing member 619B may be performed at portions facing the pressing surface 64*b* of the stripping pad 64 as shown in FIG. 6B or at portions facing the outside surface 64*c* of the stripping pad 64 (refer to FIG. 2B). Two pairs of the first pressing member 619A and the second pressing member 619B may be provided to press the fixing belt 610 against both fixing roll 611 and stripping pad 64.

Third Exemplary Embodiment

Next, the third exemplary embodiment of the present invention will be described.

Figure 7A:
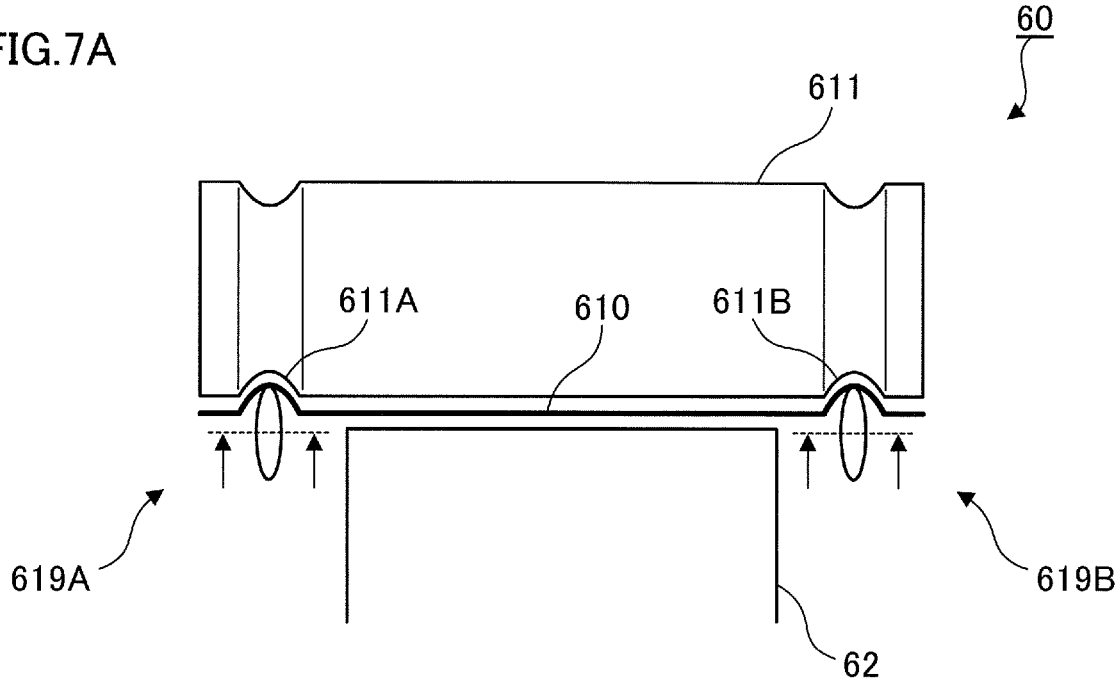
FIGS. 7A and 7B illustrate a fixing roll and fixing belt in a third exemplary embodiment.
Figure 7B:
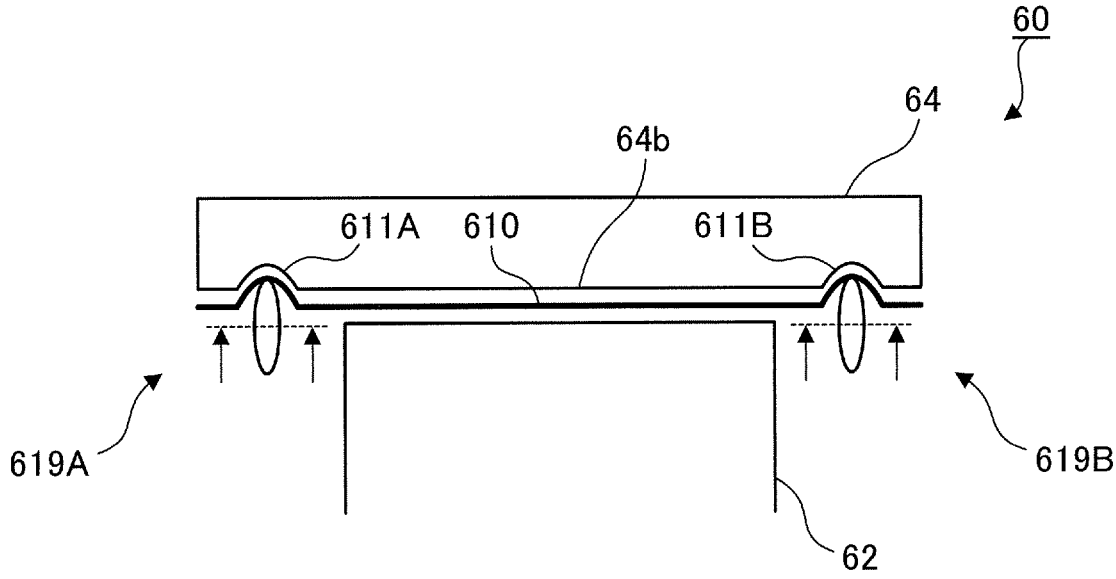

FIGS. 7A and 7B illustrate the fixing roll 611 and the fixing belt 610 in the third exemplary embodiment. In the fixing device 60 in this exemplary embodiment, as shown in FIG. 7A, a first groove 611A is formed in one end portion of the fixing roll 611 along the circumferential direction thereof, and a second groove 611B is formed in the other end portion of the fixing roll 611 along the circumferential direction thereof. In other words, on the surface of the fixing roll 611 facing the fixing belt 610, the first groove 611A and the second groove 611B are formed along the moving direction of the fixing belt 610.

In this exemplary embodiment, a first pressing member 619A, which is formed to have a width narrower than that of the first groove 611A, is pressed against the first groove 611A and a second pressing member 619B, which is formed to have a width narrower than that of the second groove 611B, is pressed against the second groove 611B. Accordingly, one end portion of the fixing belt 610 is deformed to follow the first groove 611A and the other end portion of the fixing belt 610 is deformed to follow the second groove 611B. Due to the deformation, tension is applied to the fixing belt 610 in the width direction thereof. In this case, also, cockle in a sheet rarely occurs.

As in the first and second exemplary embodiments, the pressing of the fixing belt 610 by the first pressing member 619A and the second pressing member 619B may be performed at the pressure drop portion, but may alternatively be performed at the roll nip portion N1 or at the upstream side of the roll nip portion N1 in the moving direction of the fixing belt 610. The pressing of the fixing belt 610 by the first pressing member 619A and the second pressing member 619B may be performed at portions facing the pressing surface 64*b* of the stripping pad 64 as shown in FIG. 7B or at portions facing the outside surface 64*c* of the stripping pad 64 (refer to FIG. 2B). Two pairs of the first pressing member 619A and the second pressing member 619B may be provided to press the fixing belt 610 against both fixing roll 611 and stripping pad 64.

Fourth Exemplary Embodiment

Next, the fourth exemplary embodiment of the present invention will be described.

Figure 8:
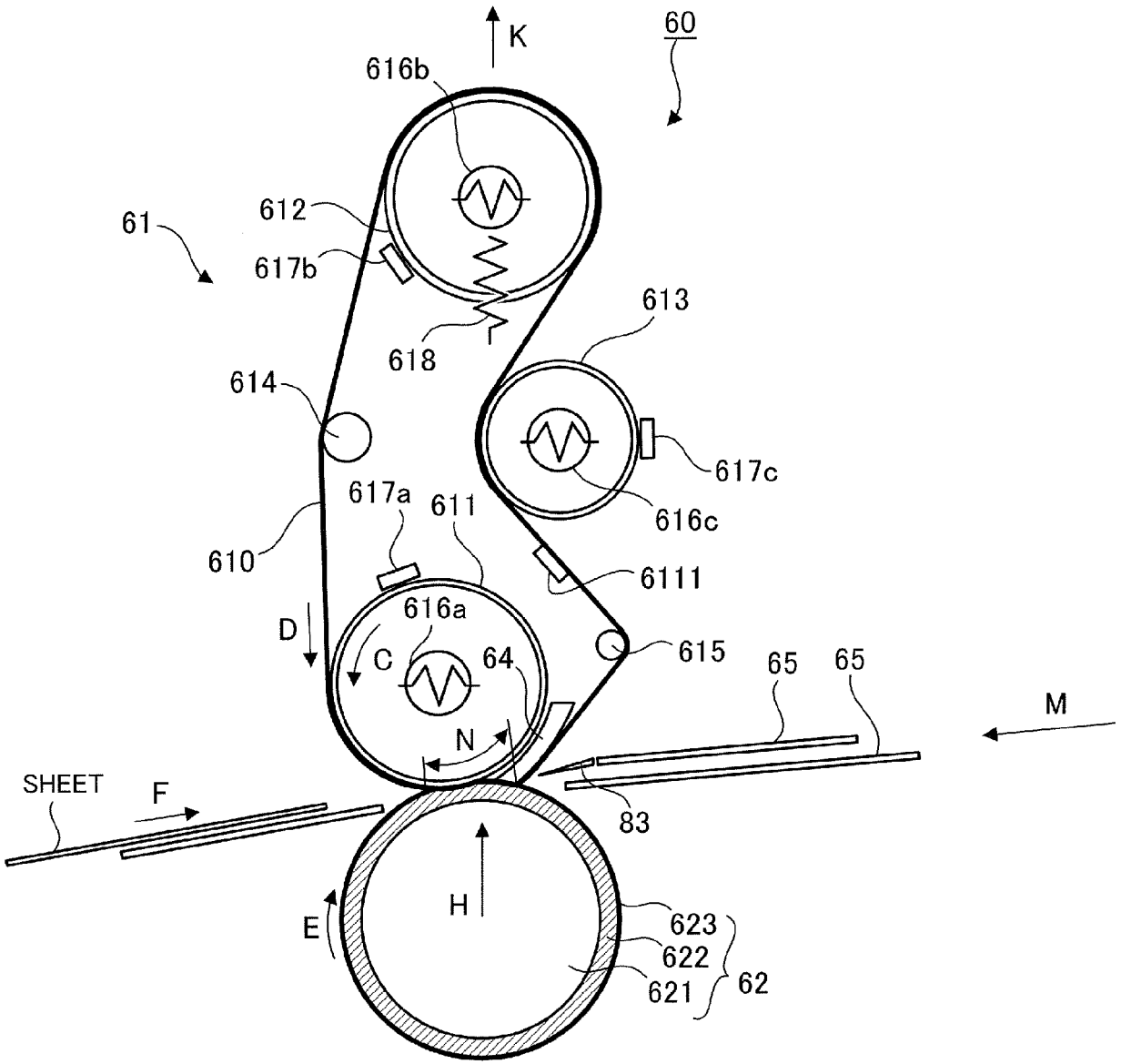
FIG. 8 illustrates a fixing device to which a fourth exemplary embodiment is applied.
Figure 9A:
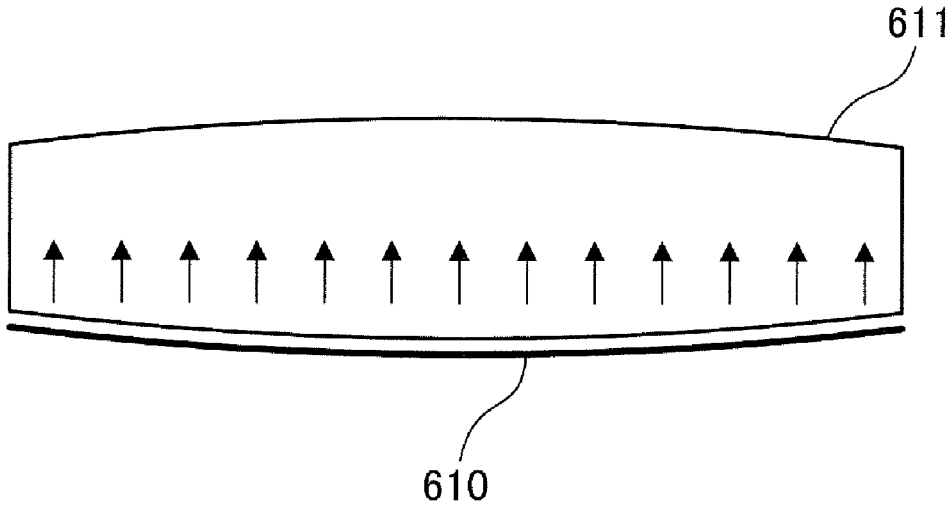
FIGS. 9A and 9B illustrate the fixing device to which the fourth exemplary embodiment is applied.
Figure 9B:
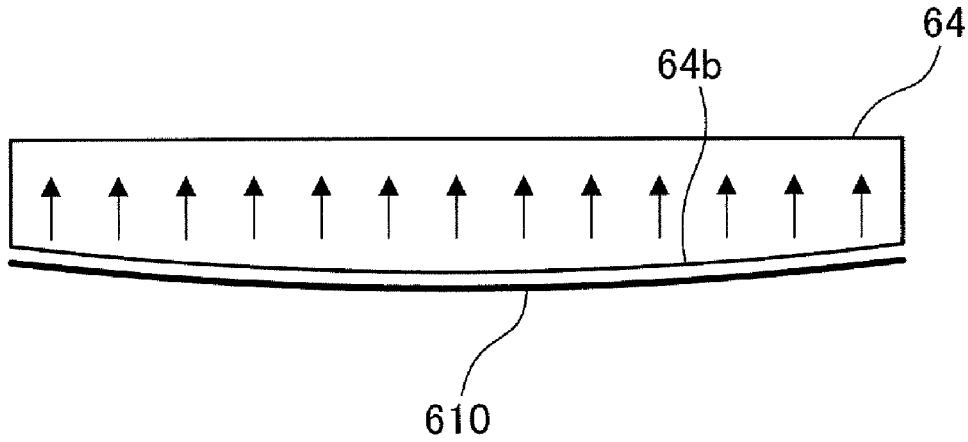

FIGS. 8, 9A and 9B illustrate the fixing device 60 in the fourth exemplary embodiment. In these figures, parts or members having same functions as those of the first to third exemplary embodiments are provided with same reference numerals, and explanations thereof are omitted. FIGS. 9A and 9B illustrate the fixing roll 611, the stripping pad 64 and the fixing belt 610 as the fixing device 60 is viewed from the direction of arrow M shown in FIG. 8.

As shown in FIG. 8, in the fixing device 60 of this exemplary embodiment, spring members 618 that press (urge) the first tension roll 612 in a direction away from the nip portion N (refer to arrow K in the figure) are disposed at both end portions of the first tension roll 612. In other words, the spring members 618 are disposed at both end portions of the first tension roll 612 to press the first tension roll 612 in a same direction as the pressure roll 62 presses the fixing belt module 61 (refer to arrow H in the figure). In the fixing device 60 of this exemplary embodiment, as shown in FIG. 9A, the fixing roll 611 is formed to have a crown portion. That is, the fixing roll 611 is formed so that an outer diameter thereof is reduced along with a move toward both end portions. In other words, the fixing roll 611 is formed with a curvature so that a surface facing the fixing belt 610 is bent inward along with a move from a center portion to both end portions in the longitudinal direction of the fixing roll 611.

In this exemplary embodiment, as described above, the spring members 618 that press the first tension roll 612 in a direction away from the nip portion N (fixing roll 611, stripping pad 64) are disposed. Therefore, as shown by arrows in FIG. 9A, a load to press the inner peripheral surface of the fixing belt 610 against the fixing roll 611 is applied to the fixing belt 610. In other words, the fixing belt 610 is urged, and thereby the inner peripheral surface thereof is pressed against the fixing roll 611. Here, as described above, the fixing roll 611 is formed to have a crown portion; accordingly, tension is also applied to the fixing belt 610 in the width direction thereof in this exemplary embodiment. In this case, the looseness in the fixing belt 610 at the pressure drop portion hardly occurs, too, and tension is also applied to the sheet. As a result, cockle in the sheet rarely occurs in this exemplary embodiment.

In this exemplary embodiment, as shown in FIG. 9B, the stripping pad 64 is also formed to have a crown portion. That is, the pressing surface 64*b* of the stripping pad 64 is formed such that it is separated from the pressure roll 62 along with a move toward both end portions of the stripping pad 64. More specifically, the pressing surface 64*b* is formed with a curvature to be bent inward of the fixing belt 610 along with a move from a center portion to both end portions in the longitudinal direction of the stripping pad 64. Accordingly, the pressing surface 64*b* of the stripping pad 64 provides tension to the fixing belt 610 in the width direction thereof.

In this exemplary embodiment, both fixing roll 611 and pressing surface 64*b* are formed to have crown portions, but only one of them may have a crown portion.

Figure 10:
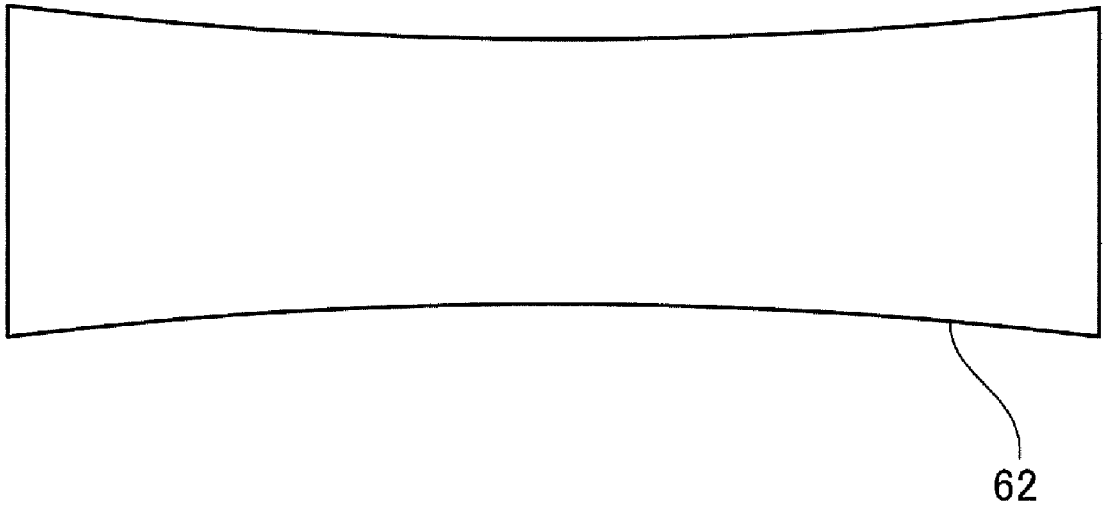
FIG. 10 illustrates a form of a pressure roll.

In the fixing device 60 of the first to fourth exemplary embodiments, as shown in FIG. 10, the pressure roll 62 may be formed to have a flare portion in which the outer diameter thereof becomes larger along with a move toward the end portion. With such a shape of the pressure roll 62, tension is applied to a sheet in the width direction thereof, and therefore wrinkles rarely occur in the sheet.

In the fixing device 60 of the first to fourth exemplary embodiments, a heat source is not provided to the side of the pressure roll 62; therefore, heating of the sheet is mainly performed by the side of the fixing belt 610. The shrinkage of the sheet, which contributes to the cockle in the sheet, is likely to take place at a side of the sheet that is in contact with the fixing belt 610 compared to the other side of the sheet because more water vapor occurs at the side of the sheet facing the fixing belt 610. Accordingly, the above first to fourth exemplary embodiments, in which the fixing belt 610 is provided with tension and thereby the sheet is provided with tension from the side of the fixing belt 610 where the shrinkage of the sheet is apt to occur, may suppress the shrinkage of the sheet more effectively. When the pressure roll 62 has a flare portion as described above, wrinkles that tend to occur in a trail edge portion of the sheet may be suppressed, but cockle in a lead edge portion of the sheet as shown in FIG. 4 may not be suppressed in many cases.

In the first to fourth exemplary embodiments, the case where tension is provided to the fixing belt 610 is described as an example, but the fixing belt 610 may be simply pressed to suppress the looseness in the fixing belt 610. For example, in FIGS. 5A and 5B, the fixing belt 610 is not pressed in a direction orthogonal to the inner peripheral surface of the fixing belt 610, but pressed in a direction intersecting the direction orthogonal to the inner peripheral surface of the fixing belt 610. However, the fixing belt 610 may be pressed in the direction orthogonal to the inner peripheral surface of the fixing belt 610. In other words, in FIGS. 5A and 5B, the first pressing member 619A and the second pressing member 619B are disposed to be outwardly inclined, but the first pressing member 619A and the second pressing member 619B may be disposed without such inclination. With such a configuration, though tension in the width direction of the sheet is hard to be provided, the looseness in the fixing belt 610 is suppressed at the pressure drop portion, thereby suppressing the cockle in the sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member provided to be circularly movable;

a first fixing member disposed inside the belt member;

a second fixing member that is disposed to be in press contact with the first fixing member across the belt member, and forms a press contact portion between the belt member and the second fixing member;

a pressing member that presses the belt member against the second fixing member, the pressing member having a pressing surface that presses an inner peripheral surface of the belt member on a downstream side of the press contact portion in a moving direction of the belt member; and a suppressing unit that suppresses looseness in a portion of the belt member in a width direction thereof, the portion being located on the downstream side of the press contact portion and an upstream side of the pressing surface in the moving direction of the belt member.

2. The fixing device according to claim 1, wherein the suppressing unit provides tension to the portion of the belt member in the width direction thereof.

3. The fixing device according to claim 2, wherein the suppressing unit provides the tension to the portion of the belt member in the width direction thereof by directly applying a load to the portion of the belt member.

4. The fixing device according to claim 2, wherein the suppressing unit provides the tension to the portion of the belt member in the width direction thereof by pressing one end portion in the width direction of the belt member in a direction away from the other end portion of the belt member, and pressing the other end portion of the belt member in a direction away from the one end portion of the belt member.

5. The fixing device according to claim 2, wherein the first fixing member and the pressing member are disposed in parallel, in a longitudinal direction thereof, to the width direction of the belt member, the first fixing member has a surface facing the belt member, the surface being formed to be bent inward of the belt member along with a move from a center portion to both end portions in the longitudinal direction of the first fixing member, and the suppressing unit presses the belt member against the surface of the first fixing member facing the belt member to provide the tension to the portion of the belt member in the width direction thereof.

6. The fixing device according to claim 2, wherein the first fixing member and the pressing member are disposed in parallel, in a longitudinal direction thereof, to the width direction of the belt member, the pressing surface of the pressing member is formed to be bent inward of the belt member along with a move from a center portion to both end portions in the longitudinal direction of the pressing member, and the suppressing unit presses the belt member against the pressing surface of the pressing member to provide the tension to the portion of the belt member in the width direction thereof.

7. The fixing device according to claim 2, wherein the first fixing member and the pressing member are disposed in parallel, in a longitudinal direction thereof, to the width direction of the belt member, a surface of the first fixing member that faces the belt member and the pressing surface of the pressing member are formed to be bent inward of the belt member along with a move from a center portion to both end portions in the longitudinal direction of the first fixing member and the pressing member, respectively, and the suppressing unit presses the belt member against the surface of the first fixing member facing the belt member and the pressing surface of the pressing member to provide the tension to the portion of the belt member in the width direction thereof.

8. An image forming apparatus comprising:

an image forming unit that forms an image on a recording medium; and a fixing unit that fixes the image on the recording medium, the image having been formed on the recording medium by the image forming unit, wherein the fixing unit comprises:

a belt member provided to be circularly movable;

a first fixing member disposed inside the belt member;

a second fixing member that is disposed to be in press contact with the first fixing member across the belt member, and forms, between the belt member and the second fixing member, a press contact portion which the recording medium passes through;

a pressing member that presses the belt member against the second fixing member, the pressing member having a pressing surface that presses an inner peripheral surface of the belt member on a downstream side of the press contact portion in a moving direction of the belt member; and a suppressing unit that suppresses looseness in a portion of the belt member in a width direction thereof, the portion being located on the downstream side of the press contact portion and an upstream side of the pressing surface in the moving direction of the belt member.

9. The image forming apparatus according to claim 8, wherein the suppressing unit provides tension to the portion of the belt member in the width direction thereof.

10. The image forming apparatus according to claim 9, wherein the first fixing member has a surface facing the belt member, the surface being provided with a first groove and a second groove formed along the moving direction of the belt member, and the suppressing unit presses one end portion in the width direction of the belt member against the first groove and presses the other end portion in the width direction of the belt member against the second groove to provide the tension to the portion of the belt member in the width direction thereof.

11. The image forming apparatus according to claim 9, wherein the pressing surface of the pressing member has a first groove and a second groove formed along the moving direction of the belt member, and the suppressing unit presses one end portion in the width direction of the belt member against the first groove and presses the other end portion in the width direction of the belt member against the second groove to provide the tension to the portion of the belt member in the width direction thereof.

12. The image forming apparatus according to claim 9, wherein each of a surface of the first fixing member that faces the belt member and the pressing surface of the pressing member is provided with a first groove and a second groove formed along the moving direction of the belt member, and the suppressing unit presses one end portion in the width direction of the belt member against the first groove and presses the other end portion in the width direction of the belt member against the second groove for each of the surface of the first fixing member and the pressing surface of the pressing member to provide the tension to the portion of the belt member in the width direction thereof.

13. The image forming apparatus according to claim 9, wherein the first fixing member and the pressing member are disposed in parallel, in a longitudinal direction thereof, to the width direction of the belt member, the first fixing member has a surface facing the belt member, the surface being formed to be bent inward of the belt member along with a move from a center portion to both end portions in the longitudinal direction of the first fixing member, and the suppressing unit urges the belt member so that the inner peripheral surface is pressed against the surface of the first fixing member facing the belt member to provide the tension to the portion of the belt member in the width direction thereof.

14. The image forming apparatus according to claim 9, wherein the first fixing member and the pressing member are disposed in parallel, in a longitudinal direction thereof, to the width direction of the belt member, the pressing surface of the pressing member is formed to be bent inward of the belt member along with a move from a center portion to both end portions in the longitudinal direction of the pressing member, and the suppressing unit urges the belt member so that the inner peripheral surface is pressed against the pressing surface of the pressing member to provide the tension to the portion of the belt member in the width direction thereof.

15. The image forming apparatus according to claim 9, wherein the first fixing member and the pressing member are disposed in parallel, in a longitudinal direction thereof, to the width direction of the belt member, a surface of the first fixing member that faces the belt member and the pressing surface of the pressing member are formed to be bent inward of the belt member along with a move from a center portion to both end portions in the longitudinal direction of the first fixing member and the pressing member, respectively, and the suppressing unit urges the belt member so that the inner peripheral surface is pressed against the surface of the first fixing member facing the belt member and the pressing surface of the pressing member to provide the tension to the portion of the belt member in the width direction thereof.

* * * * *